US007839204B2

(12) United States Patent
Park

(10) Patent No.: US 7,839,204 B2
(45) Date of Patent: Nov. 23, 2010

(54) CORE VOLTAGE GENERATION CIRCUIT AND SEMICONDUCTOR DEVICE HAVING THE SAME

(75) Inventor: Jae-Boum Park, Kyoungki-do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 108 days.

(21) Appl. No.: 12/164,282

(22) Filed: Jun. 30, 2008

(65) Prior Publication Data

US 2009/0058510 A1 Mar. 5, 2009

(30) Foreign Application Priority Data

Aug. 29, 2007 (KR) ..... 10-2007-0087232

(51) Int. Cl.
*G05F 1/10* (2006.01)

(52) U.S. Cl. ..... 327/540

(58) Field of Classification Search ..... 327/540, 327/541

See application file for complete search history.

(56) References Cited

U.S. PATENT DOCUMENTS 5,352,935 A * 10/1994 Yamamura et al. ..... 327/540
5,373,477 A * 12/1994 Sugibayashi ..... 365/226
6,184,744 B1 * 2/2001 Morishita ..... 327/541
6,407,538 B1 * 6/2002 Kinoshita et al. ..... 323/314
6,456,155 B2 * 9/2002 Takai ..... 327/541
6,753,721 B2 * 6/2004 Otsuka et al. ..... 327/540
6,985,027 B2 * 1/2006 Yabe ..... 327/541
7,417,494 B2 * 8/2008 Choi et al. ..... 327/541

FOREIGN PATENT DOCUMENTS

KR 1020060031027 A 4/2006
KR 1020060111798 A 10/2006

OTHER PUBLICATIONS

Foreign Office Action issued on Oct. 13, 2008 in the corresponding KR application 10-2007-0087232 with an English translation.

* cited by examiner

*Primary Examiner*—Jeffrey S Zweizig
(74) *Attorney, Agent, or Firm*—IP & T Group LLP

(57) ABSTRACT

A semiconductor memory device includes a voltage detector configured to detect a voltage level of an external power supply voltage, a first core voltage generation driver configured to operate when the external power supply voltage is in a high level region and a second core voltage generation driver configured to operate when the external power supply voltage is in a low level region.

10 Claims, 3 Drawing Sheets

CORE VOLTAGE GENERATION CIRCUIT AND SEMICONDUCTOR DEVICE HAVING THE SAME

CROSS-REFERENCE TO RELATED APPLICATION

The present invention claims priority of Korean patent application number 10-2007-0087232, filed on Aug. 29, 2007, which is incorporated by reference in its entirety.

BACKGROUND OF THE INVENTION

The present invention relates to a semiconductor memory device, and more particularly, to a core voltage generation circuit for generating core voltage.

A semiconductor memory device is used in storing data in a variety of applications. Such a semiconductor memory device is widely used in desktop computers, notebook computers and portable electronic apparatuses. Therefore, there is a need for the semiconductor memory device of large capacity, high speed, small size and low power.

In order to achieve the semiconductor memory device of low power, a method for minimizing power consumption in a core area of the memory device has been proposed. The core area includes a memory cell, a bit line and a word line, and is designed according to an ultra-fine design rule. To design an ultra-fine semiconductor memory device for performing high frequency operations, it is essential to lower power source voltage.

The semiconductor memory device uses an internal voltage of a voltage level adequate for operations in an internal circuit of the semiconductor memory device, which is generated by an external power supply voltage (VDD) lower than a certain voltage level. Specifically, a memory device, such as a dynamic random access memory (DRAM), which utilizes a bit line sense amplifier, uses a core voltage (VCORE) to sense cell data. When a word line is enabled, data in a plurality of memory cells connected to the word line are transferred to bit lines, and then the bit line sense amplifiers sense and amplify voltage differences of bit line pairs. Generally, thousands of bit line sense amplifiers are operated at the same time. Thus, a large amount of current is consumed at a time at a core voltage terminal to drive pull-up power lines of the bit line sense amplifiers.

FIG. 1 is a circuit diagram of a conventional core voltage generation circuit.

Referring to FIG. 1, the conventional core voltage generation circuit includes a comparator 10, an amplifier 11 and a feedback voltage generator 12. The comparator 10 differentially compares a feedback voltage of half core voltage (½ voltage level of a potential at a core voltage terminal) and a reference voltage (VREFC) (of ½ voltage level of a target core voltage; 0.75 V). The amplifier 11 generates an amplified core voltage of approximately 1.5 V in response to an output signal of the comparator 10. The feedback voltage generator 12 divides the amplified core voltage, and outputs the feedback voltage having ½ voltage level of the potential at the core voltage terminal to monitor the core voltage. The conventional core voltage generation circuit further includes a control switch 13 configured to control operations of the comparator 10.

The core voltage generation circuit determines operation point of the comparator 10 using an external power supply voltage VDD applied to an NMOS transistor MN1 constituting the control switch 13.

As the NMOS transistor MN1 is turned on in response to the external power supply voltage VDD and the NMOS transistor MN2 is turned on in response to the reference voltage VREFC applied from the outside, drain voltages of the transistors MN1 and MN2 are lowered. That is, the potential of the node N1 is lowered. Then, a low level signal is applied to a gate of a PMOS transistor MP3 to turn on the PMOS transistor MP3, thereby increasing the core voltage VCORE output from the core voltage generation circuit.

As the core voltage VCORE is increased, the feedback voltage is also increased to thereby turn on an NMOS transistor MN3. As the NMOS transistor MN3 is turned on, a potential of the node N2 is decreased to decrease a voltage level applied to gates of the PMOS transistors MP1 and MP2. As a result of the decrease of the voltage level at the gates of the PMOS transistors MP1 and MP2, the PMOS transistors MP1 and MP2 are turned on, thereby increasing a potential of the node N1 gradually. That is, a gate voltage of the PMOS transistor MP3 is gradually increased. Such operations are repeated until the feedback voltage becomes equal to the reference voltage VREFC.

The conventional core voltage generation circuit determines an operation point of the comparator 10 using the external power supply voltage VDD applied to the gate of the NMOS transistor MN1 constituting the control switch 13. However, the external power supply voltage VDD inevitably has an error range within a certain range because it is applied from the outside.

Therefore, the turn on characteristic (current path) of the NMOS transistor MN1 is determined by the external power supply voltage VDD applied to the control switch 13. The turn on characteristic of the NMOS transistor MN1 affects the turn on characteristic of the NMOS transistor MN2 in the comparator 10, and thus the turn on characteristic of the PMOS transistor MP3 in the amplifier 11.

However, as described above, the conventional core voltage generation circuit determines the operation point of the comparator 10 only through the NMOS transistor MN1 regardless of the voltage level of the external power supply voltage VDD. Therefore, the conventional core voltage generation circuit has the limitation that the core voltage VCORE may become instable according to the external power supply voltage VDD.

Such a conventional core voltage generation circuit performs the same controls regardless of whether the external power supply voltage is higher or lower than the reference voltage. That is, the generation of the core voltage is controlled by the two-stage amplifier using the same internal bias driver. Therefore, the conventional core voltage generation circuit has the limitation that the output level of the core voltage is not constant, for example, the output core voltage is high when the external power supply voltage is high, and the output core voltage is low when the external power supply voltage is low. Particularly, the amplifier generating the core voltage includes only one PMOS transistor. Accordingly, if the amplification characteristic of the PMOS transistor is set with reference to a high level region of the external power supply voltage, insufficient drivability may be caused in a low level region of the external power supply voltage. In addition, if the amplification characteristic of the PMOS transistor is set with reference to the low level region of the external power supply voltage, noise and power consumption may be increased.

SUMMARY OF THE INVENTION

Embodiments of the present invention are directed to providing a core voltage generation circuit that generates a stable core voltage regardless of a voltage level of an external power supply voltage input thereinto.

Embodiments of the invention are also directed to providing a core voltage generation circuit that controls the number of the operating internal bias driver according to variation in an external power supply voltage to generate a stable core voltage regardless of the variation in the external power supply voltage.

In accordance with an aspect of the invention, there is provided a voltage detector configured to detect a voltage level of an external power supply voltage, a first core voltage generation driver configured to operate when the external power supply voltage is in a high level region and a second core voltage generation driver configured to operate when the external power supply voltage is in a low level region.

DESCRIPTION OF SPECIFIC EMBODIMENTS

Hereinafter, a semiconductor memory device in accordance with the present invention will be described in detail with reference to the accompanying drawings.

Figure 2:
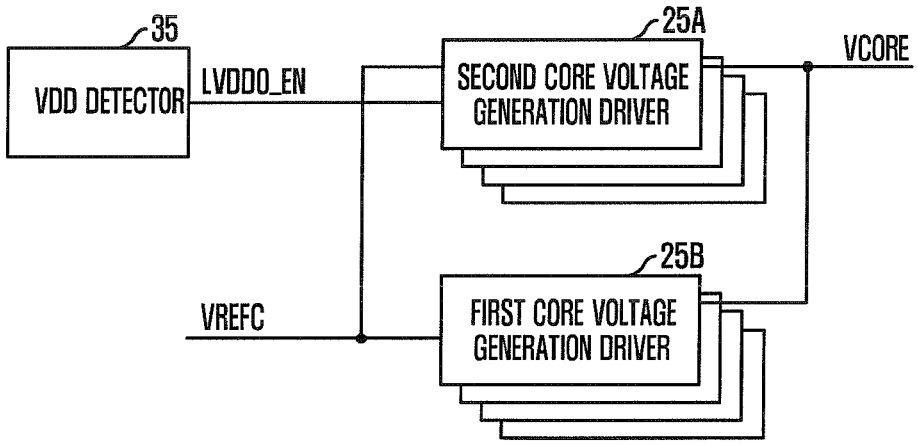
FIG. 2 is a block diagram of a core voltage generation circuit in accordance with an embodiment of the present invention.

FIG. 2 is a block diagram of a core voltage generation circuit in accordance with an embodiment of the invention. Referring to FIG. 2, the core voltage generation circuit includes a VDD detector 35 and a second core voltage generation driver 25A and a first core voltage generation driver 25B. The VDD detector 35 detects a voltage level of an external power supply voltage VDD to generate a low external power supply voltage enable signal LVDD_EN according to the detection result. The first and second core voltage generation drivers 25B and 25A are selectively operated according to whether the external power supply voltage is in a high level region or in a low level region of the external power supply voltage to generate a core voltage.

Figure 3:
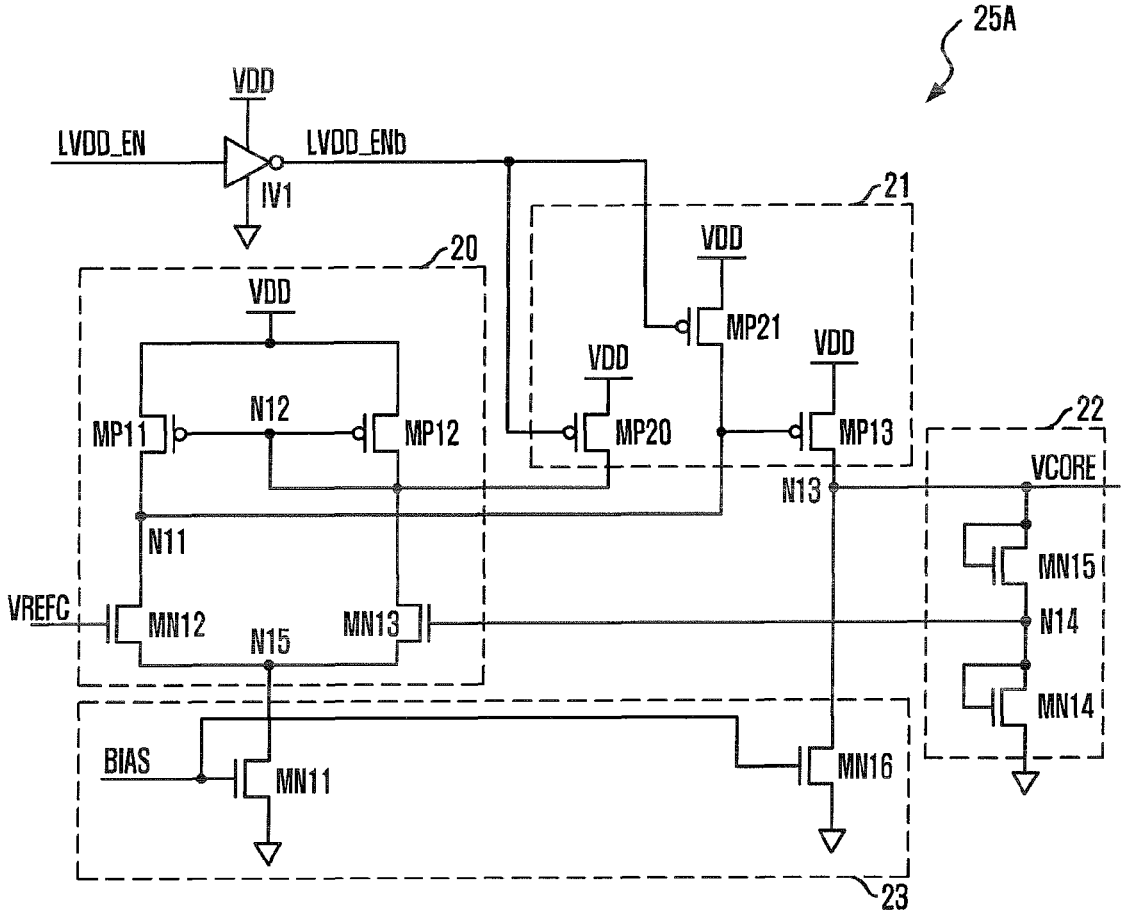
FIG. 3 is a circuit diagram of a core voltage generation driver of the core voltage generation circuit of FIG. 2.

The second core voltage generation driver 25A is operated to satisfy drivability in the low level region of the external power supply voltage while it is turned off in the high level region of the external power supply voltage. The second core voltage generation driver 25A is illustrated in FIG. 3. Accordingly, the operation of the second core voltage generation driver 25A will be described later with reference to FIG. 3.

Figure 1:
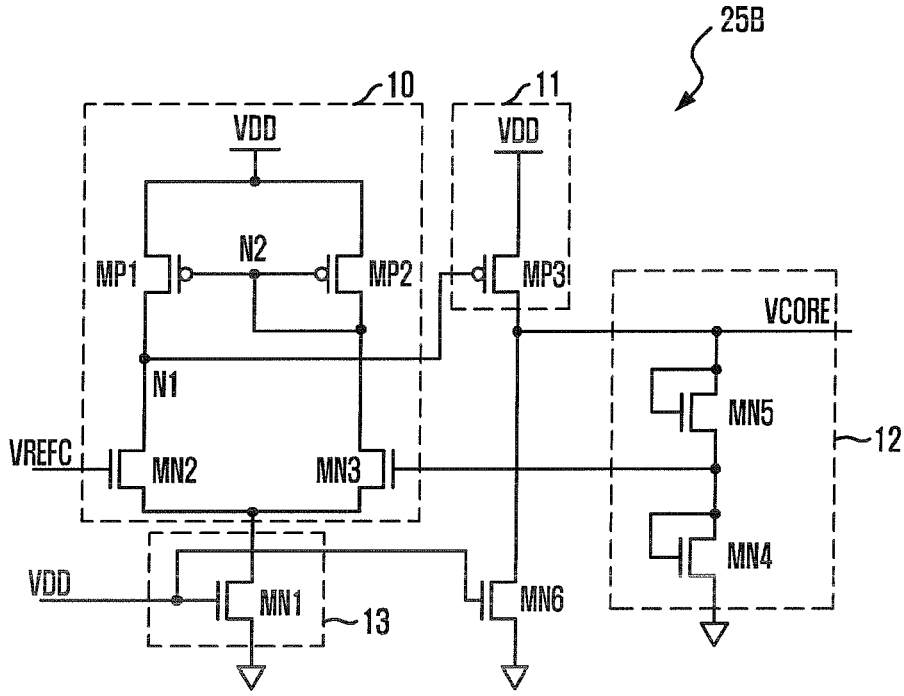
FIG. 1 (RELATED ART)
FIG. 1 is a circuit diagram of a conventional core voltage generation circuit.

The first core voltage generation driver 25B is tuned to be optimized in the high level region of the external power supply voltage. The first core voltage generation driver 25B is always operated regardless of the voltage level of the external power supply voltage VDD. Accordingly, the first core voltage generation driver 25B is a typical driver used in a DRAM, as shown in FIG. 1.

The VDD detector 35 compares a voltage level of a predetermined portion of the external power supply voltage VDD with a voltage level of a reference voltage VREF. If the voltage level of the predetermined portion of the external power supply voltage VDD is lower than the voltage level of the reference voltage VREF, the VDD detector 35 generates a high level signal, i.e., a low external power supply voltage LVDD_EN of a high level. If the voltage level of the predetermined portion of the external power supply voltage VDD is higher than the voltage level of the reference voltage VREF, the VDD detector 35 generates a low level signal, i.e., a low external power supply voltage LVDD_EN of a low level. Detailed description of configuration and operation of the VDD detector 35 will be given later with reference to FIG. 4.

The reference voltage VREF is used as a reference for comparison with the external power supply voltage VDD. The reference voltage VREF has a voltage level within a predetermined voltage range (experimental value) of the rated external power supply voltage. Accordingly, the external power supply voltage VDD having a voltage level slightly lower than the predetermined voltage range of the rated external power supply voltage is referred to as an external power supply voltage in a low level region. The external power supply voltage VDD having a voltage level slightly higher than the predetermined voltage range of the rated external power supply voltage is referred to as an external power supply voltage in a high level region.

When the low level signal is output from the VDD detector 35, the second core voltage generation driver 25A determines that the applied external power supply voltage VDD is in the high level region. Therefore, the second core voltage generation driver 25A is turned off to output no core voltage.

However, in this case, the first core voltage generation driver 25B is operated to generate a stable core voltage in the high level region of the external power supply voltage.

On the contrary, when the high level signal is output from the VDD detector 35, the second core voltage generation driver 25A determines that the applied external power supply voltage VDD is in the low level region. Therefore, the second core voltage generation driver 25A is turned on to generate the core voltage. At the same time, the first core voltage generation driver 25B is also turned on to generated the core voltage.

Accordingly, in the low level region of the external power supply voltage, both of the first and second core voltage generation drives 25B and 25A are operated, and an insufficient voltage level of the core voltage generated by the first core voltage generation driver 25B is compensated by the second core voltage generation driver 25A.

Hereinafter, a method for generating a stable core voltage by differentiating the number of the operating core voltage generation drivers according to the voltage level of the external power supply voltage VDD will be described with reference to FIG. 3.

Referring to FIG. 3, the core voltage generation circuit 25 includes a comparator 20, an amplifier 21, a feedback voltage generator 22 and a control switch 23. The comparator 20 differentially compares a feedback voltage and a reference voltage VREFC. The feedback voltage may be a half core voltage having one half of the voltage level of the core voltage terminal. The reference voltage VREFC has one half of the voltage level of a target core voltage (0.75V). The amplifier 21 amplifies a core voltage to approximately 1.5 V in response to an output signal of the comparator 20. The feedback voltage generator 22 divides the amplified core voltage to generate the feedback voltage having one half of the voltage level of the core voltage terminal for monitoring the core voltage. The control switch 23 opens and closes current paths of the comparator 20 and the amplifier 21 to enable and disable the comparator 20 and the amplifier 21.

The comparator 20 includes two NMOS transistors MN12 and MN13 performing differential comparison in response to the reference voltage VREFC applied from the outside and the feedback voltage having one half of the voltage level of core voltage. Sources of the two transistors MN12 and MN13 are connected to each other through a node N15. The reference voltage VREFC is applied to a gate of the transistor MN12, and the feedback voltage is applied to a gate of the transistor MN13. A drain of the transistor MN12 is connected in series to the PMOS transistor MP11 through a node N11. The external power supply voltage VDD is applied to a source of the PMOS transistor MP11. A drain of the transistor MN13 is connected in series to a PMOS transistor MP12, and a gate and a drain of the transistor MP12 are connected to each other through a node N12. A gate of the PMOS transistor MP11 is also connected to the node N12. The external power supply voltage VDD is applied to a source of the transistor MP12.

The amplifier 21 includes a PMOS transistor MP13 having a gate connected to the node N11, a source receiving the external power supply voltage VDD, and a drain outputting an amplified core voltage VCORE. An NMOS transistor MN16 is connected in series between the PMOS transistor MP13 and a ground voltage.

The amplifier 21 further includes PMOS transistors MP20 and MP21 configured to operate in the low level region of the external power supply voltage to compensate the operation characteristic of the PMOS transistor MP13. The PMOS transistor has a source connected to the external power supply voltage VDD and a drain connected to the node N12. The PMOS transistor MP21 has a source connected to the external power supply voltage VDD and a drain connected to the node N11. Gates of the PMOS transistors MP20 and MP21 receive the low external power supply voltage enable signal LVDD_EN from the VDD detector 35 through an inverter IV1.

The control switch 23 includes NMOS transistors MN11 and MN16. The NMOS transistor MN11 has a drain connected to the node N15 of the comparator 20, a gate configured to receive a bias voltage BIAS from the outside, and a source connected to a ground voltage. The NMOS transistor MN16 has a drain connected to the node N13 of the amplifier 21, a gate receiving the bias voltage, and a source connected to the ground voltage.

The feedback voltage generator 22 includes NMOS transistors MN14 and MN15 connected in series to each other through a node N14. The NMOS transistors MN14 and MN15 are connected in series between an output terminal N13 for the core voltage generated by the amplifier 21 and the ground terminal. The node N14 is connected to the gate of the transistor MN13 of the comparator 20. A drain and a gate of the transistor MN14 are connected to each other, which is the same to the transistor MN15. That is, the core voltage is divided by the two transistors MN14 and MN15. The divided core voltage is transferred to a gate of the transistor MN13 of the comparator 20 to turn on the transistor MN13.

Hereinafter, an operation of the core voltage generation circuit in accordance with the embodiment of the invention will be described.

In order to operate the core voltage generation circuit 25 configured with a two-stage amplifier, there is a need for detecting the voltage level of the external power supply voltage VDD input thereto to determine whether the external power supply voltage VDD is in a high level region (of the external power supply voltage) or a low level region (of the external power supply voltage). As a result, a low external power supply voltage enable signal LVDD_EN is generated. Depending on the detected voltage level of the external power supply voltage VDD, the first and second core voltage generation drivers 25B and 25A are selectively operated.

Therefore, the first and second core voltage generation drivers 25B and 25A are operated selectively according to the voltage level of the external power supply voltage VDD. This will be described later with reference to FIG. 4. When the divided external power supply voltage is lower than the reference voltage, the low external power supply voltage enable signal LVDD_EN is applied as a high level signal. The high level signal is inverted to a low level signal by the inverter IN1. As such, the high level signal is applied to the gates of the PMOS transistors MP20 and MP21 to turn on the two transistors MP20 and MP21.

Meanwhile, the transistor MN11, which is a current source of the comparator 20, is turned on to form a current path of the comparator 20.

As the transistor MN12 is turned on by the reference voltage VREFC, voltage level of the node N11 is lowered, and as the transistor MN11 is turned on, voltage level of the node N15 is lowered. The potential of the node N11 varies in connection with that of the node N15. That is, as the potential of the node N15 is lowered, the potential of the node N11 is also lowered accordingly.

Here, the low level signal at the node N11 turns on the PMOS transistor MP13 constituting the amplifier 21 to apply an amplified core voltage to the node N13. Further, as the drain voltages of the transistor MN12 and MN11 are lowered, the turn on characteristic of the transistor MP13 is increased gradually, thereby increasing the output core voltage.

The feedback voltage for monitoring the core voltage is divided by the transistors MN15 and MN14 before being applied to the gate of the NMOS transistor MN13. The turning on of the transistor MN13 lowers the gate voltages of the PMOS transistors MP11 and MP12.

As the gate voltages of the transistors MP11 and MP12 are lowered, the transistors MP11 and MP12 are turned on, and thus the voltage level at the node N11 increases gradually. Resultantly, the gate voltage of the transistor MP13, which is turned on/off in response to the voltage of the node N11, is also increased gradually.

Since the transistor MP13 is a PMOS transistor, increase of the gate voltage decreases the turn on characteristic of the transistor MP13, thereby decreasing the output core voltage. As a result, the comparator 20 repeats the differential comparison until the feedback voltage for monitoring the core voltage becomes equal to the reference voltage VREFC.

Meanwhile, to the node N11 is connected the PMOS transistor MP21 which is configured to operate in the low level region of the external power supply voltage. Accordingly, the turned on PMOS transistor MP21 controls the potential of the node N11.

In addition, to the node N12 is connected the PMOS transistor MP20 which is configured to operate in the low level region of the external power supply voltage. Accordingly, the turned on PMOS transistor MP20 controls the potential of the node N12.

Therefore, the operations of the comparator 20, and the amplifier 21 which generates the core voltage, are affected by the external power supply voltage VDD transferred through the turned on PMOS transistors MP20 and MP21. Accordingly, the amplifier 21 generates the core voltage requiring compensation in the low level region of the external power supply voltage.

In this case where the second core voltage generation driver 25A is operated to generate the core voltage, the first core voltage generation driver 25B, which has the configurations shown in FIG. 1, is also operated to generate the core voltage. Since the configurations and operations thereof have been described with reference to FIG. 1, a detailed description thereof will be omitted here.

As a result, when the applied external power supply voltage VDD is in the low level region, the core voltage generated by the first core voltage generation driver 25B having the configuration shown in FIG. 1 is added with the compensation core voltage generated by the second core voltage generation driver 25A of FIG. 3 to be output as the core voltage. As such, although the applied external power supply voltage VDD is in the low level region, the core voltage generated by the first core voltage generation driver 25B is compensated with the core voltage generated by the second core voltage generation driver 25A to make it possible to generate a stable core voltage.

On the contrary, when the applied external power supply voltage VDD is in the high level region, the VDD detector 35 generates the low external power supply voltage enable signal LVDD_EN of a low level. This low level signal is inverted by the inverter IV1 to a high level signal to turn off the PMOS transistors MP20 and MP21. Then, the PMOS transistors MP20 and MP21 do not affect the PMOS transistor MP13, which serves as an amplifier. In addition, as described above, the second core voltage generation driver 25A of FIG. 3 should be disabled in the high level region of the external power supply voltage. Therefore, in order to disable the second core voltage generation driver 25A, it is preferable to turn off the control switch 23, which serves as a current source for determining the operation points of the comparator 20 and the amplifier 21.

As described above, the core voltage generation circuit divides the possible voltage level of the external power supply voltage VDD to the high level region and the low level region. Then, the core voltage generation circuit controls the number of operating core voltage generation drivers according to whether the applied external power supply voltage VDD is in the high level region or in the low level region. As such, the core voltage generation circuit can generate a stable core voltage regardless of the variations in the voltage level of the external power supply voltage VDD.

Figure 4:
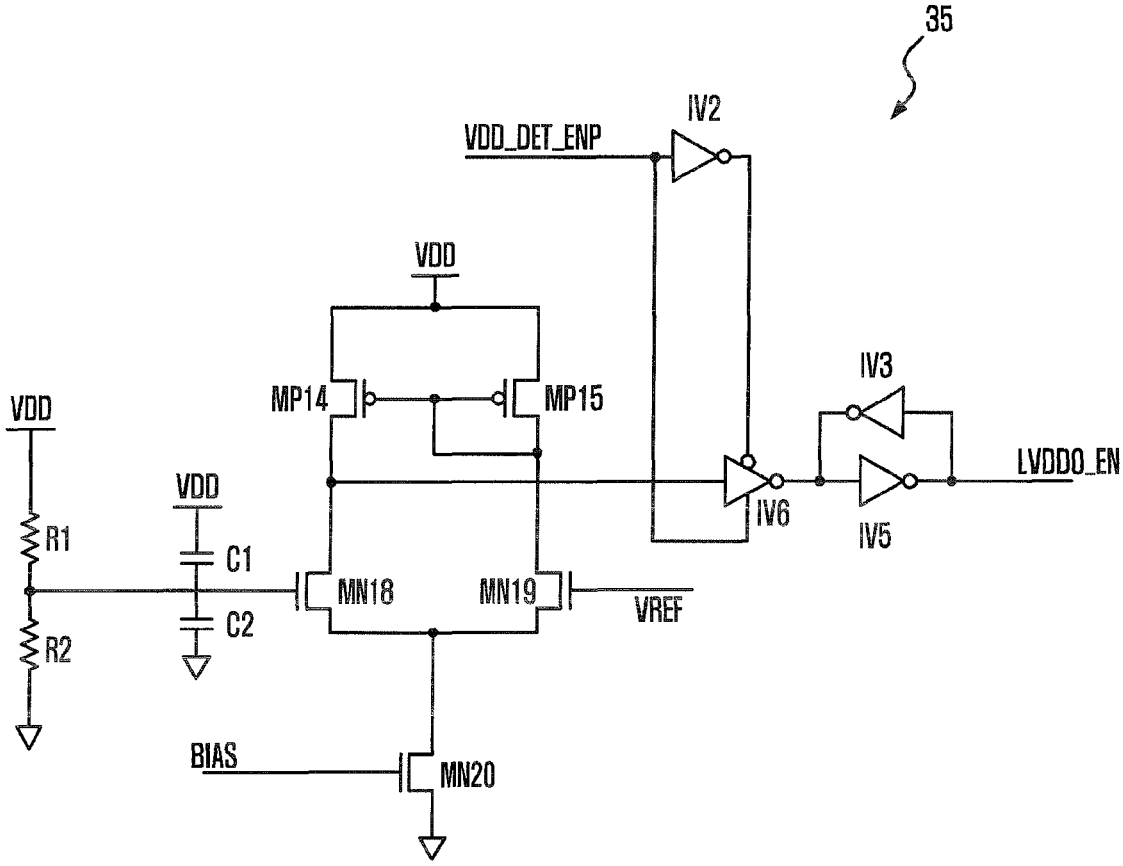
FIG. 4 is a circuit diagram of a VDD detector of the core voltage generation circuit of FIG. 2.

Hereinafter, the VDD detector of the semiconductor memory device of FIG. 2 will be described with reference to FIG. 4.

The VDD detector includes a voltage divider, a comparator, a switch, inverters IV6, IV5 and IV3 and an inverter IV2. The voltage divider includes resistors R1 and R2 and capacitors C1 and C2 to divide the external power supply voltage VDD. The comparator includes NMOS transistors MN18 and MN19 and PMOS transistors MP14 and MP15 to differentially compare the divided external power supply voltage received from the voltage divider and the reference voltage VREF. The switch includes an NMOS transistor MN20 for forming a current path for the comparator. The inverters IV6, IV5 and IV3 invert the comparison results. The inverter IV2 receives a pulse signal VDD_DET_ENP generated after the external power supply voltage is stabilized. The reference voltage VREF is predetermined to detect a voltage level of the external power supply voltage VDD.

In the VDD detector, the voltage level of the external power supply voltage VDD is divided before being compared with the voltage level of the reference voltage. That is, when the voltage level of the divided external power supply voltage is higher than the voltage level of the reference voltage, the transistor MN18 is turned on so that the inverter IV6 outputs a high level signal. The high level signal is inverted by the inverter IV5 to a low level signal.

That is, when the voltage level of the divided external power supply voltage is higher than the voltage level of the reference voltage, the external power supply voltage is considered to be in a high level region. Then, the VDD detector outputs a low external power supply voltage enable signal LVDD_EN of a low level.

On the contrary, when the voltage level of the divided external power supply voltage is lower than the voltage level of the reference voltage, the transistor MN19 is turned on so that the inverter IN6 outputs a low level signal. This low level signal is inverted by the inverter IV5 to a high level signal.

That is, when the voltage level of the divided external power supply voltage is lower than the voltage level of the reference voltage, the external power supply voltage is considered to be in a low level region. Then, the VDD detector outputs a low external power supply voltage enable signal LVDD_EN of a high level.

As described above, the core voltage generation circuit detects the voltage level of the applied external power supply voltage VDD to determine whether the applied external power supply voltage VDD is in the high level region or in the low level region. As such, the core voltage generation circuit can generate a stable core voltage regardless of the variations in the voltage level of the applied external power supply voltage VDD. Particularly, the core voltage generation circuit can control the number of operating internal bias drivers to generate a stable core voltage regardless of the variations in the voltage level of the external power supply voltage VDD.

While the invention has been described with respect to the specific embodiments, it will be apparent to those skilled in the art that various changes and modifications may be made without departing from the spirit and scope of the invention as defined in the following claims.

What is claimed is:

1. A core voltage generation circuit, comprising:

a voltage detector configured to detect whether a voltage level of an external power supply voltage is lower than a voltage level of a first reference voltage and to generate a low external power supply voltage enable signal according to a detection result;

a first core voltage generation driver configured to operate regardless of the voltage level of the external power supply voltage; and a second core voltage generation driver configured to operate in response to the low external power supply voltage enable signal output from the voltage detector when the voltage level of the external power supply voltage is lower than the voltage level of the first reference voltage.

2. The core voltage generation circuit as recited in claim 1, wherein the first core voltage generation driver includes:

a comparator configured to compare a feedback voltage and a second reference voltage;

an amplifier configured to amplify the external power supply voltage according to an output signal of the comparator to generate a core voltage; and a feedback voltage generator connected between an output terminal of the amplifier and a ground voltage, and configured to output the feedback voltage to the comparator for monitoring the core voltage.

3. The core voltage generation circuit as recited in claim 1, wherein the second core voltage generation driver generates a compensation core voltage for compensating the core voltage generated by the first core voltage generation driver when the voltage level of the external power supply voltage is lower than the voltage level of the first reference voltage.

4. The core voltage generation circuit as recited in claim 3, wherein the second core voltage generation driver includes a comparator configured to differentially compare a feedback voltage and the second reference voltage, and a core voltage generator configured to generate the compensation core voltage according to an output signal of the comparator when the voltage level of the external power supply voltage is lower than the voltage level of the first reference voltage.

5. The core voltage generation circuit as recited in claim 4, wherein the core voltage generator includes a switch turned on according to an output signal of the voltage detector, and an amplifier controlled by the switch to amplify the external power supply voltage according to the output signal of the comparator.

6. The core voltage generation circuit as recited in claim 5, wherein the core voltage generator further includes an inverter to invert the output signal of the voltage detector to output the inverted signal to the switch.

7. The core voltage generation circuit as recited in claim 6, wherein the switch includes a PMOS transistor.

8. A core voltage generation circuit, comprising:

a voltage detector configured to detect a voltage level of an external power supply voltage;

a first core voltage generation driver configured to operate when the external power supply voltage is in a high level region; and a second core voltage generation driver configured to operate when the external power supply voltage is in a low level region, wherein the second core voltage generation driver includes a comparator configured to differentially compare a first feedback voltage and a reference voltage, and a core voltage generator configured to generate a compensation core voltage according to an output signal of the comparator when the external power supply voltage is in the low level region.

9. The core voltage generation circuit as recited in claim 8, wherein the first core voltage generation driver operates regardless of the voltage level of the external power supply voltage.

10. The core voltage generation circuit as recited in claim 8, wherein the first core voltage generation driver includes:

a comparator configured to compare a second feedback voltage and the reference voltage;

an amplifier configured to amplify the external power supply voltage according to an output signal of the comparator to generate a core voltage; and a feedback voltage generator connected between an output terminal of the amplifier and a ground voltage, and configured to output the second feedback voltage to the comparator for monitoring the core voltage.

* * * * *